US011235902B2

(12) United States Patent
Schinelli et al.

(10) Patent No.: US 11,235,902 B2
(45) Date of Patent: Feb. 1, 2022

(54) CONTAINER LABELING MACHINE

(71) Applicant: P.E. LABELLERS S.P.A., Porto Mantovano (IT)

(72) Inventors: Nicola Schinelli, Mantova (IT); Bruno Negri, Marmirolo (IT)

(73) Assignee: P.E. LABELLERS S.P.A., Porto Mantovano (IT)

( * ) Notice: Subject to any disclaimer, the term of this patent is extended or adjusted under 35 U.S.C. 154(b) by 79 days.

(21) Appl. No.: 16/635,241

(22) PCT Filed: Jul. 31, 2018

(86) PCT No.: PCT/EP2018/070795
§ 371 (c)(1),
(2) Date: Jan. 30, 2020

(87) PCT Pub. No.: WO2019/030063
PCT Pub. Date: Feb. 14, 2019

(65) Prior Publication Data

US 2020/0346811 A1 Nov. 5, 2020

(30) Foreign Application Priority Data

Aug. 7, 2017 (IT) ..... 102017000090958

(51) Int. Cl.
*B65C 9/02* (2006.01)
*B67C 7/00* (2006.01)

(52) U.S. Cl.
CPC ..... *B65C 9/02* (2013.01); *B67C 7/0046* (2013.01)

(58) Field of Classification Search
CPC ..... B65C 9/02; B65C 9/04; B67C 7/0046; Y10T 156/1771
See application file for complete search history.

(56) References Cited

U.S. PATENT DOCUMENTS 2,540,120 A * 2/1951 Jacobs ..... B67C 7/0046 53/510
2005/0098269 A1* 5/2005 Ballarotti ..... B65C 3/14 156/567

(Continued)

FOREIGN PATENT DOCUMENTS

CN 2844011 Y 12/2006
CN 101971221 A 2/2011

(Continued)

OTHER PUBLICATIONS

IT, Ministry of Economic Development, Search Report and Opinion (with English translation), Italian Patent Application No. 10 2017000090958, 7 pages, dated May 4, 2018.

(Continued)

*Primary Examiner* — Philip C Tucker
*Assistant Examiner* — John Blades
(74) *Attorney, Agent, or Firm* — Thompson Hine LLP

(57) ABSTRACT

A container labeling machine, which comprises a base structure which forms a region for the input of the containers to be labeled and at least one region for the output of the labeled containers and supports elements for the conveyance of the containers from the input region to the output region, at least one container labeling assembly being provided along the conveyor; the conveyor comprises at least two carousels provided with respective supporting plates for individual containers. At least one respective labeling assembly is associated with each one of the carousels. The conveyor furthermore comprises, substantially at the input region, elements for sorting the containers fed to the input region toward one and the other of the carousels and comprises elements for unloading the labeled containers from the carousels and for sending the labeled containers toward the output region.

7 Claims, 3 Drawing Sheets

(56) References Cited

U.S. PATENT DOCUMENTS

| | | | | |
|---|---|---|---|---|
| 2009/0173779 | A1 | 7/2009 | Szesko | |
| 2011/0041979 | A1* | 2/2011 | Leykamm | B65C 3/06 156/60 |
| 2012/0085071 | A1* | 4/2012 | Hahn | B29C 49/78 53/411 |
| 2013/0192766 | A1 | 8/2013 | Erhart | |
| 2017/0348757 | A1 | 12/2017 | Kurosawa | |

FOREIGN PATENT DOCUMENTS

| | | | |
|---|---|---|---|
| CN | 102481989 | A | 5/2012 |
| CN | 206068332 | U | 4/2017 |
| DE | 1133664 | B | 7/1962 |
| DE | 2636515 | A1 | 2/1978 |
| EP | 2439048 | A1 | 4/2012 |
| WO | 2013/094587 | A1 | 6/2013 |
| WO | WO 2016114060 | A1 | 7/2016 |

OTHER PUBLICATIONS

PCT, European Patent Office (ISA/EP), International Search Report, International Application No. PCT/EP/2018/070795, 3 pages, dated Nov. 15, 2018.

PCT, European Patent Office (ISA/EP), Written Opinion of the International Searching Authority, International Application No. PCT/EP/2018/070795, 6 pages, dated Nov. 15, 2018.

* cited by examiner

CONTAINER LABELING MACHINE

The present invention relates to a container labeling machine.

As is known, container labeling machines commonly have a rotating carousel, provided with plates for supporting the individual containers to be labeled, and a labeling assembly or station, which is laterally adjacent to the carousel and is designed to apply a label to each container carried by the carousel.

Current labeling machines can be provided with a labeling assembly of the so-called "roll-fed" type, in which the labels are obtained starting from a ribbon wound in a roll, on which multiple labels are printed continuously.

Labeling assemblies of the roll-fed type typically have a drum which receives the ribbon, retaining it on its surface, so as to allow to perform the cutting of the individual labels, which are conveyed by the drum until they are brought to application on the containers carried by the carousel. The ribbon can be pre-adhesive, i.e., provided beforehand with adhesive on one of its faces, or can have no pre-applied adhesive and in this case the labeling assembly is provided with adapted means for applying adhesive to the labels.

Labeling machines are also commercially available which are provided with labeling assemblies commonly known as "self-adhesive", i.e., which work with pre-adhesive labels which are associated with a backing ribbon which is provided wound in rolls. These labeling assemblies are provided with a separation device, which is located in the vicinity of the containers to be labeled, conveyed by the carousel, and separates the individual labels from the backing ribbon in order to apply them to the respective containers, while the backing ribbon, now without the labels, is recovered by means of a roller onto which it is rewound.

Labeling machines are often inserted in packaging lines between a blow-forming machine and a filling machine, according to a system commonly known as "triple block".

One technical problem that is strongly felt in this field is linked to the fact that increasingly often, in order to be introduced in a packaging line, the labeling machine is required to have a very high production rate in terms of number of bottles labeled per hour, a rate which, while achievable in theory with appropriate contrivances by the part that constitutes the conveyance system, i.e., by the rotating carousel, would be actually very difficult to execute by the part that constitutes the labeling assembly.

One hypothetical solution to this problem might be to provide the packaging line with two labeling machines instead of one, so that the required total production rate is ensured while allowing each labeling machine to operate at half of the overall production rate.

However, this solution has the disadvantage of a considerable commitment of capital on the part of the companies that are dedicated to packaging, as well as the complication of the packaging line, which would have to be split in two upstream of the labeling machine, something which moreover is impossible to do in the case of a line configuration as provided in the triple block system.

Another attempt to solve this problem that has been proposed consists in providing a single labeling machine and in increasing the number of labeling assemblies or stations of the roll-fed type associated with the individual carousel that is present on the machine and capable of operating simultaneously, so as to be able to reduce the operating rate of the individual labeling assemblies that are present, i.e., of the parts of the machine that have the greatest problems in reaching high rates.

In this case, the two labeling assemblies associated with the carousel are alternated in applying the labels to the containers arriving from the carousel.

This solution has first of all the limitation that it can be applied only to roll-fed labeling assemblies, due to the kinematic system that regulates the other types of labeling assembly.

Moreover, this solution is feasible only if changes in its operation are also applied to the labeling machine, but these changes have more or less evident flaws and disadvantages.

One should in fact consider that in order to allow correct application of the labels by the roll-fed labeling assemblies, each container to be labeled must have the same peripheral speed as the drum that applies the labels.

In a labeling machine provided with a rotating carousel with two roll-fed labeling assemblies associated therewith, the speed of each applicator drum can be reduced with respect to a traditional machine, but since the peripheral speed imparted by the carousel to the containers must remain unchanged in order to ensure hourly production, the rotation rate of the individual containers about themselves must be reduced considerably with respect to the traditional case.

This entails a larger space required by the individual label in order to be wrapped around the corresponding container and the consequence that in the application of the labels on the part of the individual labeling assemblies to alternating containers, the containers that must not be labeled by a specific labeling assembly touch the label that is being wrapped around the directly preceding container.

An attempt is made to solve this drawback, as mentioned above, with some corrective modifications, such as for example severely limiting the diameters of the containers that can be processed.

Another corrective implementation that is used consists in applying fixed or movable pads in order to modify locally the diameter of the applicator drum of each labeling assembly, so that it only makes contact with the containers that it is required to label and not with the directly subsequent ones.

Further corrective procedures used are to impart to the individual containers, by means of adapted servomotors, an acceleration to their rotation about themselves that is higher than the one strictly necessary just after the pickup of the corresponding label by the containers, or to use systems for smoothing the labels, provided with suction devices, in order to move the applied label away from the container that is not to be wrapped.

All these contrivances, in addition to introducing considerable constructive complexity in the machines, have not proved to be fully satisfactory as regards their effectiveness.

Even in the case of labeling machines with a self-adhesive labeling assembly, there is the problem of being able to meet the requirements of packaging with a high production rate especially of formats with a long label, since the peripheral speed of the containers arranged on the carousel would be higher than the one that can be reached mechanically by the self-adhesive labeling assembly.

In this case also, the hypothetical solution of using two labeling machines is not feasible owing to the economic and logistical disadvantages described previously.

The aim of the present invention is to provide a container labeling machine that is capable of improving the background art in one or more of the aspects indicated above.

Within this aim, an object of the invention is to provide a container labeling machine that is capable of meeting the demand for production at high speed, even if higher than the speed limits that can be reached by labeling assemblies, without however incurring in the mentioned drawbacks.

Another object of the invention is to provide a container labeling machine that allows an extremely high total hourly production without requiring modifications to the packaging line that is already present or the presence of particular corrective variations.

A further object of the invention is to provide a labeling machine that allows to achieve a high hourly production rate in a relatively simple manner from the constructive standpoint and at relatively low costs.

A still further object of the present invention is to overcome the drawbacks of the background art in a manner which is different from any existing solutions.

This aim, as well as these and other objects which will become better apparent hereinafter, are achieved by a container labeling machine according to claim 1, optionally provided with one or more of the characteristics of the dependent claims.

Further characteristics and advantages of the invention will become better apparent from the description of some preferred but not exclusive embodiments of the container labeling machine according to the invention, illustrated by way of non-limiting example in the accompanying drawings, wherein.

Figure 1:
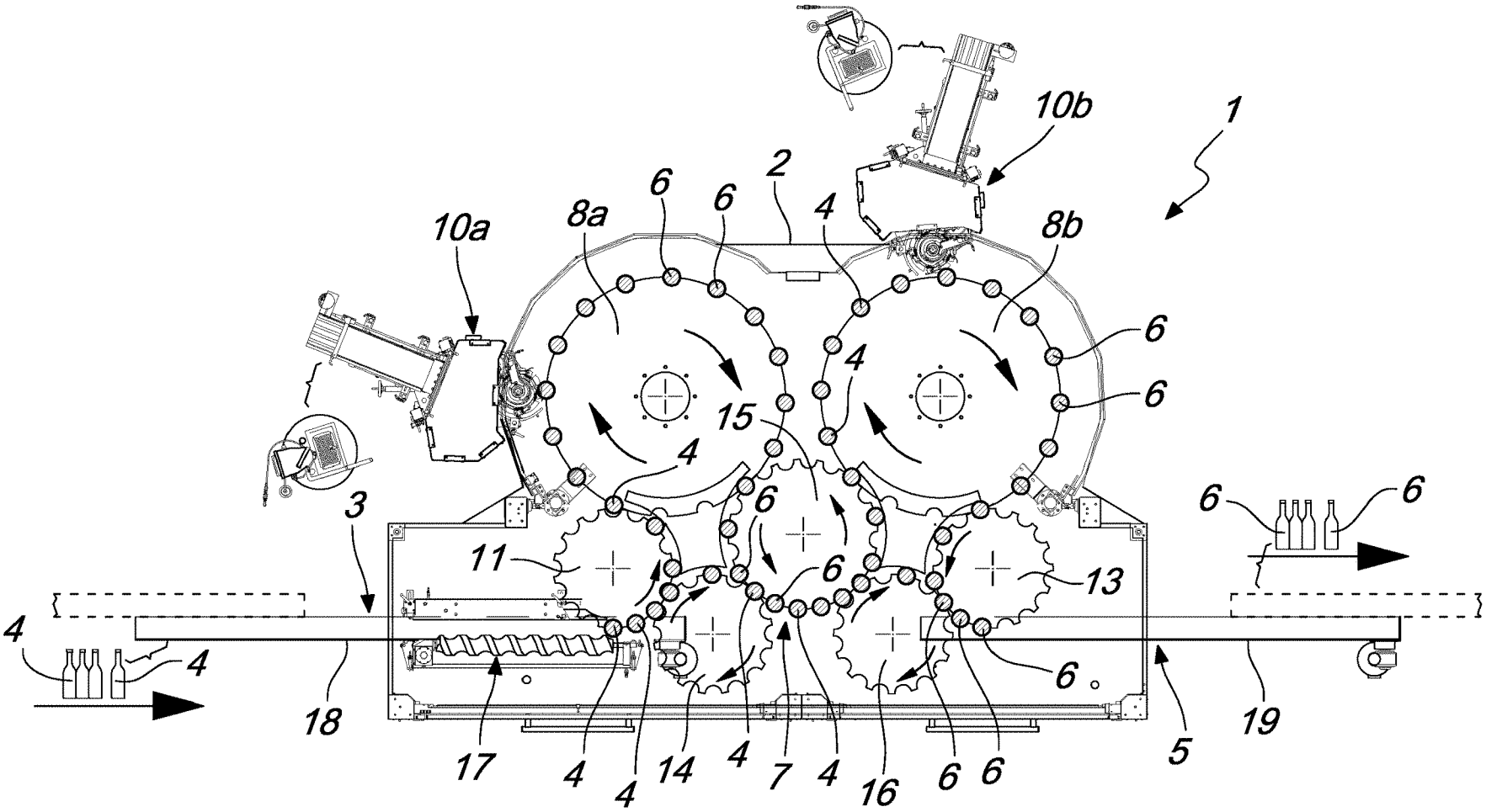
FIG. 1 is a schematic top plan view of the machine according to the invention in a first embodiment.

With reference to the cited figures, the labeling machine according to the invention, designated generally by the reference numeral 1, comprises a base structure 2 which forms an input region 3 of the containers 4 to be labeled and at least one output region 5 of the labeled containers 6.

For example, the input region 3 and the output region 5 are arranged on mutually opposite sides of the base structure 2 of the machine.

The base structure 2 supports conveyance means 7 which allow to convey the containers from the input region 3 to the output region 5.

Along said conveyance means 7 there is at least one assembly for labeling the containers conveyed by the conveyance means 7.

The particularity of the invention resides in that the conveyance means 7 comprise at least two carousels 8*a*, 8*b*, each of which is provided with respective supporting plates for individual containers.

In particular, at least one respective labeling assembly 10*a* and 10*b* is associated with each one of the carousels 8*a* and 8*b*.

Also according to the invention, the conveyance means 7 comprise, substantially at the input region 3, container sorting means which allow to send the containers 4 to be labeled, fed to the input region 3, toward one and the other of the carousels 8*a* and 8*b*, so that they can be labeled by the corresponding labeling assemblies 10*a* and 10*b*.

Furthermore, there are means for unloading the labeled containers 6 from the carousels 8*a*, 8*b*, which are designed to pick up or in any case receive the labeled containers 6 from the carousels 8*a* and 8*b* and send them toward the output region 5.

It should be noted that the presence on the machine according to the invention of the carousels 8*a* and 8*b* provided with respective labeling assemblies 10*a* and 10*b* allows to achieve a high hourly production in terms of number of containers labeled per hour, maintaining however the operating speed of the labeling assemblies 10*a* and 10*b* well below the maximum speed that they can achieve, without requiring corrective measures to their operation, as in the background art, or the multiplication of the packaging lines or others, with the related technical and cost problems described above.

Figure 2:
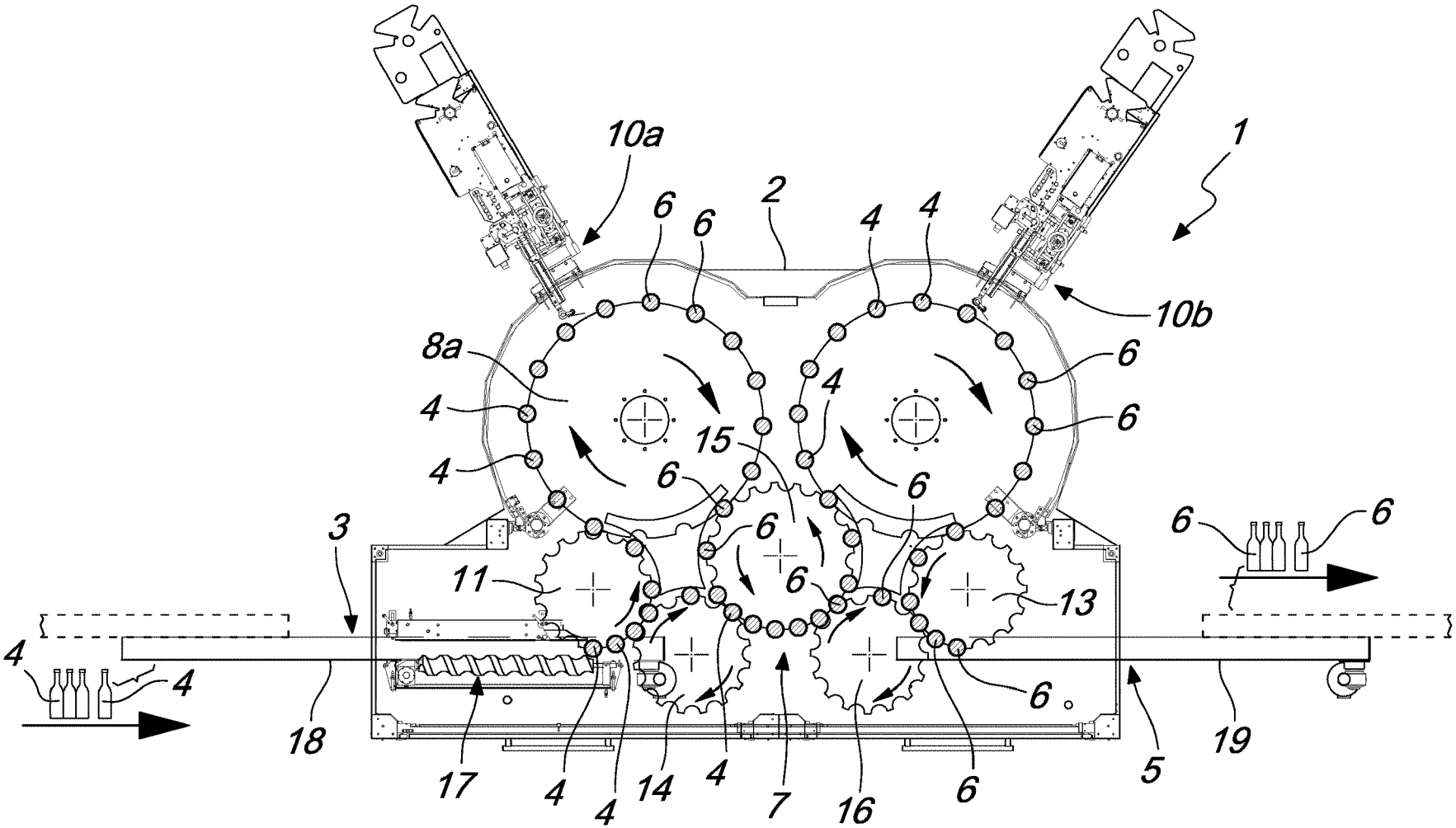
FIG. 2 is a schematic top plan view of a second embodiment of the machine according to the invention with a different type of labeling assemblies.

It should be noted that depending on the requirements the labeling assemblies 10*a* and 10*b* may be equally of the roll-fed type, as in the example shown in FIG. 1, or of the self-adhesive type, as in the example shown in FIG. 2.

Conveniently, said sorting means can be provided by at least one first selection star conveyor 11, which is designed to receive the containers 4 to be labeled which are fed to the input region 3.

In particular, the first selection star conveyor 11 is provided with means for the removable retention of the containers received by it, which can be activated or deactivated on command in order to allow the first selection star conveyor 11 to send the containers selectively toward one or the other of the carousels 8*a*, 8*b*.

Figure 3:
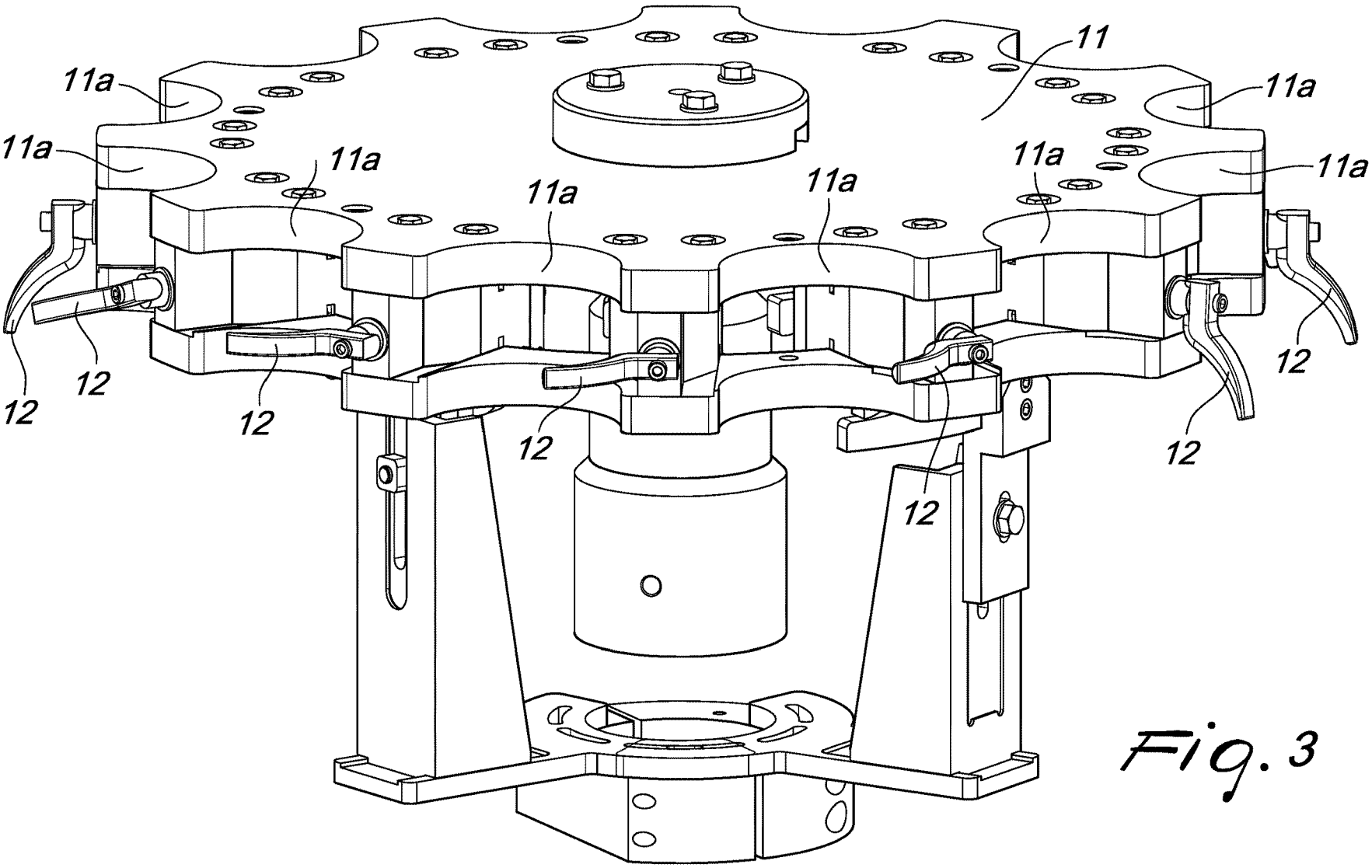
FIG. 3 is a perspective view of a selection star conveyor of the machine according to the invention.

More particularly, as shown in FIG. 3, said removable retention means are conveniently associated with the receptacles 11*a* provided at the peripheral region of the first selection star conveyor 11 in order to accommodate the containers, and are constituted for example by locking levers 12 which can be moved, in a per se known manner, by adapted actuation means, between an open position, in which they do not interfere with the containers, allowing them to be received by the first selection star conveyor 11 or to abandon it, and a closed position, in which they allow to lock the containers received from the first selection star conveyor 11, preventing their exit from the corresponding receptacle 11*a*.

Conveniently, the means for unloading the labeled containers 6 from the carousels 8*a*, 8*b* in turn comprise, downstream of said carousels along the advancement direction of the containers from the input region 3 to the output region 6, at least one output star conveyor 13, which is adapted to receive the labeled containers 6 that arrive from the carousels 8*a* and 8*b* and to send them toward the output region 6.

In greater detail, the machine according to the invention can be provided for example with at least one first carousel, which corresponds in the figures to the one designated by the reference numeral 8*a*, and with at least one second carousel, which corresponds to the one designated in the figures by the reference numeral 8*b*, and conveniently the first selection star conveyor 11 is adapted to send the containers 4 to be labeled, received one after the other, in input alternately toward the first carousel 8*a* and toward the second carousel 8*b*. In practice, depending on their order of arrival on the selection star conveyor 11, the containers 4 are sent in sequence by the selection star conveyor 11 alternately toward the first carousel 8*a* and toward the second carousel 8*b*.

In this manner, the number of containers treated by the labeling assembly 10*a* associated with the first carousel 8*a* is equal to half of the containers 4 to be labeled that are fed to the input region 3, while the remaining half of the containers to be labeled that are fed to the input region 3 is treated by the labeling assembly 10*b* associated with the second carousel 8*b*.

In practice, the receptacles 11*a* of the first selection star conveyor 11 are occupied alternately by the containers to be labeled that are intended for the first carousel 8*a* and by the containers to be labeled that are intended for the second carousel 8*b*.

As shown, the first selection star conveyor 11 can be connected to the first carousel 8*a*, so as to be able to deliver directly to the first carousel 8*a* the containers 4 that are intended for it, so that they can be labeled by the corresponding labeling assembly 10*a*, and furthermore so that it can be connected to at least one first transfer star conveyor 14 which is adapted to receive from the first selection star conveyor 13 the containers to be labeled that are intended for the second carousel 8*b*.

Conveniently, the containers taken by the first transfer star conveyor 14 are subsequently released in output to a second selection star conveyor 15, which is structurally similar to the first selection star conveyor 11 and which, in addition to receiving in input the containers to be labeled in output from the first transfer star conveyor 14, receives in input also the labeled containers in output from the first carousel 8*a*.

In practice, the receptacles of the second selection star conveyor 15 are alternately occupied by the labeled containers in output from the first carousel 8*a* and by the containers to be labeled that released by the first transfer star conveyor 14.

In particular, the second selection star conveyor 15 then sends selectively the labeled containers received from the first carousel 8*a* toward the output region 6 and delivers the containers to be labeled received from the first transfer star conveyor 14 directly to the second carousel 8*b*, so that they can be labeled by the corresponding labeling assembly 10*b*.

In greater detail, a second transfer star conveyor 16 is conveniently connected to the second selection star conveyor 15, is designed to receive from the second selection star conveyor 15 the labeled containers that arrive from the first carousel 8*a*, and in turn is connected to the output star conveyor 13, to which it releases the labeled containers that arrive from the first carousel 8*a* so that they can reach the output region 6.

As shown, the output star conveyor 13 is furthermore adapted to pick up directly the labeled containers in output from the second carousel 8*b* so as to be able to guide these, too, to the output region 6.

The receptacles of the output star conveyor 13 therefore receive, in a mutually alternating manner, the containers that arrive from the second carousel 8*a* and the containers that arrive from the second transfer star conveyor 16, as shown in the figures.

It should be noted that at least the star conveyors 11, 13 and 15 are provided with receptacles that are mutually spaced according to a predetermined distance or pitch, which is identical for all the star conveyors 11, 13 and 15, while the supporting plates 9 of the carousels 8*a* and 8*b* are mutually spaced according to a pitch that is substantially twice the pitch between the receptacles of said star conveyors 11, 13, 15. Conveniently, the transfer star conveyors 14 and 16 also have receptacles that are mutually spaced with the same pitch as the other star conveyors 11, 13 and 15, although in their case the receptacles are occupied by the corresponding containers alternately.

Advantageously, upstream of the first selection star conveyor 11 there are means 17 for spacing the containers 4 to be labeled, which are fed to the input region 3 according to the pitch between the receptacles of the star conveyors 11, 13, 14, 15, 16. Said spacing means 17 are conveniently provided by a pitch setting auger.

Conveniently, it is furthermore possible to provide, substantially at the input region 3, a line 18 for feeding the machine with the containers 4 to be labeled and, substantially at the output region 6, a line 19 for moving the labeled containers 6 away from the machine. Advantageously, both the feeding line 18 and the removal line 19 can be provided by respective conveyor belts.

Operation of the machine according to the invention is as follows.

The containers 4 to be labeled that arrive from the feeding line 18 and originate for example from a blow-forming machine are mutually spaced, in order to be arranged at the pitch of the star conveyors 11, 13, 14, 15, 16, by the spacing means 17.

At the output of the spacing means 17, the containers 4 are then picked up, one after the other, by the receptacles 11*a* of the first selection star conveyor 11, which arrive with their corresponding locking levers 12 in the open position, in order to allow the containers 4 to enter them.

Directly after the arrival of the containers 4 on the first selection star conveyor 11, the locking levers 12 of the receptacles 11*a* are actuated so that the individual containers 4 on the first selection star conveyor 11 can alternately, according to their succession determined by the direction of rotation of the first selection star conveyor 11, exit from the first selection star conveyor 11 at the first transfer star conveyor 14 or remain locked and first transfer star conveyor 14 to then exit from it at the first carousel 8*a*, so that they can therefore be labeled by the labeling assembly 10*a* of the latter.

The containers 4 received by the first transfer star conveyor 14 and then transferred by the latter to the second selection star conveyor 15, which before encountering the first transfer star conveyor 14 picks up, at alternating receptacles, also the labeled containers in output from the first carousel 8*a*.

The locking levers 12 of the receptacles of the second selection star conveyor 15 that have received the containers from the first transfer star conveyor 14 are moved to the closed position directly after the arrival of the corresponding containers, so as to lock the latter upon encountering the second transfer star conveyor 16, so as to prevent their exit, and are subsequently moved into the open position at the second carousel 8*b* in order to deliver thereto the corresponding containers, which are then labeled by the labeling assembly 10*b*, while the locking levers 12 of the receptacles of the second selection star conveyor 15 that have received the labeled containers from the first carousel 8*a* are moved into the open position after the encounter with the first transfer star conveyor 14, so that upon arrival at the second transfer star conveyor 16 the corresponding labeled containers can be transferred to the latter.

The labeled containers in output from the second carousel 8*b* are picked up, at alternating receptacles, by the output star conveyor 13, which receives, subsequently in the receptacles left free, the labeled containers that arrive from the first carousel 8*a*, which are transferred to it by the second transfer star conveyor 16.

The labeled containers 6 that arrive from the two carousels 8*a* and 8*b* are then transferred from the output star conveyor 13 to the removal line at 19, so that for example they can subsequently reach a filling machine.

In practice it has been found that the invention achieves the intended aim and objects and in particular the fact is stressed that the machine according to the invention, by virtue of the possibility to use two carousels instead of one like traditional machines, allows to achieve high hourly production levels, in terms of number of bottles labeled in the unit time, despite making the labeling assemblies operate below the maximum speed values that they can reach, without resorting to complex and scarcely effective corrective contrivances.

In other words, the machine according to the invention, for an equal hourly production rate, is capable of making its labeling assemblies operate at a lower speed than traditional single-carousel machines.

All the characteristics of the invention indicated above as advantageous, convenient or the like may also be omitted or be replaced with equivalents.

The individual characteristics described with reference to general teachings or particular embodiments may all be present in other embodiments or may replace characteristics in these embodiments.

The invention thus conceived is susceptible of numerous modifications and variations, all of which are within the scope of the appended claims; all the details may furthermore be replaced with other technically equivalent elements.

Thus, for example, the means for removable retention of the containers associated in particular with the selection star conveyors can be provided, as an alternative to locking levers, by virtue of clamp devices, which are connected to the respective receptacles and are adapted to wrap around the individual containers in a circumferential manner, or by means of a suction system with suckers.

In practice, the materials used, as well as the contingent shapes and dimensions, may be any according to the requirements and the state of the art.

The disclosures in Italian Patent Application No. 102017000090958 from which this application claims priority are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. A container labeling machine, comprising:

an input region for input of containers to be labeled and an output region for output of labeled containers; and a conveyance system for conveying containers from said input region to said output region, wherein said conveyance system includes:

first and second carousels provided with respective supporting plates for individual containers, each of said first and second carousels including a respective labeling assembly associated therewith;

a first selection star conveyor, which is adapted to receive containers to be labeled fed to said input region, said first selection star conveyor being provided with means for removable retention of containers which can be activated or deactivated on command in order to allow sending of containers from said first selection star conveyor selectively toward either said first carousel or said second carousel;

a first transfer star conveyor;

wherein said first selection star conveyor is connected to feed directly to said first carousel and is connected to said first transfer star conveyor which is adapted to receive from said first selection star conveyor containers to be labeled which are intended for said second carousel;

a second selection star conveyor, which is adapted to receive in input labeled containers in output from said first carousel and containers to be labeled in output from said first transfer star conveyor, said second selection star conveyor being adapted to send labeled containers received from said first carousel toward said output region and to deliver containers to be labeled received from said first transfer star conveyor directly to said second carousel.

2. The machine according to claim 1, further comprising: downstream of said first and second carousels, along an advancement direction of containers from said input region to said output region, an output star conveyor that is adapted to receive labeled containers that arrive from said first and second carousels and to send labeled containers toward said output region.

3. The machine according to claim 2, said first selection star conveyor being adapted to send containers to be labeled, received one after the other in input, alternately toward said first carousel and toward said second carousel.

4. The machine according to claim 2, wherein said second selection star conveyor is connected to a second transfer star conveyor, which is designed to receive from said second selection star conveyor labeled containers that arrive from said first carousel, said second transfer star conveyor being in turn connected to said output star conveyor.

5. The machine according to claim 4, wherein said output star conveyor is adapted to receive directly labeled containers in output from said second carousel and to receive labeled containers that arrive from said first carousel via said second transfer star conveyor.

6. The machine according to claim 1, wherein each of said first selection star conveyor, said first transfer star conveyor and said second selection star conveyor are provided with respective receptacles which are mutually spaced according to a preset pitch, the supporting plates of said first and second carousels being mutually spaced according to a pitch which is substantially twice the preset pitch.

7. The machine according to claim 6, further comprising, upstream of said first selection star conveyor, means for spacing containers to be labeled which are fed to said input region according to the preset pitch.

* * * * *